US006366271B1

(12) United States Patent
Kohno et al.

(10) Patent No.: US 6,366,271 B1
(45) Date of Patent: Apr. 2, 2002

(54) METHOD FOR DRIVING A LIQUID CRYSTAL DISPLAY APPARATUS AND DRIVING CIRCUIT THEREFOR

(75) Inventors: Yasuhiko Kohno; Masaru Nishimura, both of Tokyo (JP)

(73) Assignee: Mitsubishi Denki Kabushiki Kaisha, Tokyo (JP)

( * ) Notice: Subject to any disclaimer, the term of this patent is extended or adjusted under 35 U.S.C. 154(b) by 0 days.

(21) Appl. No.: 09/128,761

(22) Filed: Aug. 4, 1998

(30) Foreign Application Priority Data

Nov. 13, 1997 (JP) ..... 9-311853

(51) Int. Cl.[7] ..... G09G 3/36
(52) U.S. Cl. ..... 345/103; 345/96; 345/100
(58) Field of Search ..... 345/96, 209, 87, 345/88, 89, 98, 99, 100, 103, 208, 210, 95, 94, 97

(56) References Cited

U.S. PATENT DOCUMENTS 4,842,371 A * 6/1989 Yasuda et al. ..... 345/96
5,093,655 A * 3/1992 Tanioka ..... 345/96
5,436,635 A * 7/1995 Takahara et al. ..... 345/96
5,654,733 A * 8/1997 Chimura et al. ..... 345/96

FOREIGN PATENT DOCUMENTS

JP 2-50126 2/1990
JP 9-190162 7/1997

* cited by examiner

*Primary Examiner*—Xiao Wu
(74) *Attorney, Agent, or Firm*—Oblon, Spivak, McClelland, Maier & Neustadt, P.C.

(57) ABSTRACT

Method for driving LCD device comprises step of: applying one of upper image signal outputted from an upper liquid crystal drive circuit and lower image signal outputted from a lower liquid crystal drive circuit to a plurality of pixels of a selected line by scanning signal outputted from a scanning signal circuit out of the plurality of pixels disposed in matrix to display a predetermined image; wherein there exist in mixture a case where the polarities of the upper image signal and the lower image signal are inverted every one vertical period and a case where the same polarity is maintained. The driving circuit of LCD device of the present invention includes a vertical synchronization signal converting circuit so as to obtain upper image signal and lower image signal.

8 Claims, 17 Drawing Sheets

FIG. 5(a) $S_1$
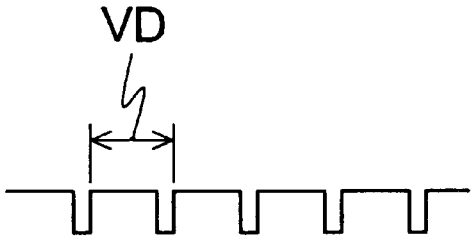
FIG. 5(b) $S_2$
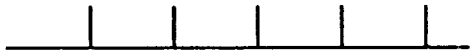
FIG. 5(c) $S_3$
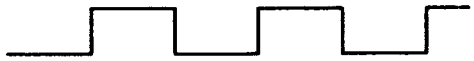
FIG. 5(d) $S_4$
FIG. 5(e) $S_5$
FIG. 5(f) $S_6$
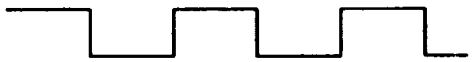

FIG. 9(a) $S_1$
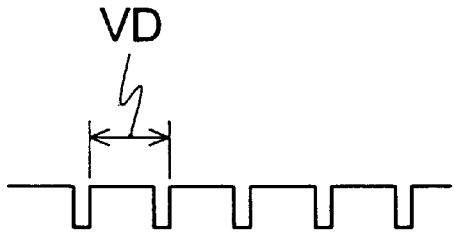
FIG. 9(b) $S_2$
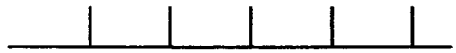
FIG. 9(c) $S_3$
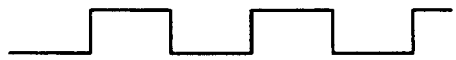
FIG. 9(d) $S_4$
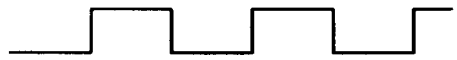
FIG. 9(e) $S_5$
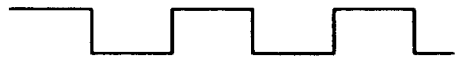
FIG. 9(f) $S_6$
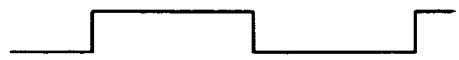
FIG. 9(g) $S_7$
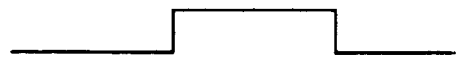

METHOD FOR DRIVING A LIQUID CRYSTAL DISPLAY APPARATUS AND DRIVING CIRCUIT THEREFOR

BACKGROUND OF THE INVENTION

The present invention relates to a method for driving an LCD device comprising a large size, high resolution color LCD panel and to a driving circuit for the LCD.

In general, an LCD crystal display device comprises an LCD panel, a scanning signal circuit for supplying a scanning signal to the LCD panel, and a liquid crystal drive circuit for supplying an image signal to the LCD panel.

The above LCD panel comprises a scanning signal line and an image signal line which is perpendicular to the scanning signal line and connected to the liquid crystal drive circuit. The scanning signal lines are disposed in parallel with one another, and connected to the scanning signal circuit.

Furthermore, the LCD panel comprises pixels arranged in matrix pattern such that the scanning signal line and the image signal line serve as boundary lines. On each crossing part of the scanning signal line and image signal line, there is provided a TFT (thin film transistor) as an active element.

The LCD device can display a prescribed image signal by (1) giving a plurality of image signals outputted from the liquid crystal drive circuit to each image signal line, (2) selecting the specified scanning signal line by the scanning signal outputted from the scanning signal circuit, (3) turning ON only the TFT connected to the selected scanning signal line, (4) applying the respective predetermined image signal only to the pixel including TFT in ON state, (5) controlling transmittance of light of liquid crystal of each pixel by the potential difference of the applied predetermined image signal.

In general, in the large size LCD device having high resolution color LCD panel, in order to maintain the operating frequency of the image data which is a signal inputted to the liquid crystal drive circuit to a level lower than the highest frequency (maximum operating frequency) in the range in which the liquid crystal drive circuit can be operated, there may be a case of providing the liquid crystal drive circuits for example on and under the LCD panel.

In the conventional LCD device as described above, when the number of pixels is increased to improve resolution, the time for the TFT to charge the image signal is restricted to be short. Also, when the size of screen is enlarged (that is, large screen is used), length of line such as the image signal line, scanning signal line requires to be long, and the wiring load becomes large. Accordingly, there arises such problems that the wave forms of the image signal and scanning signal are distorted, or the transmission speed of the image signal on the image signal line or transmission speed of the scanning signal on the scanning signal line becomes slow. Accordingly, due to the mutual effects of the preceding and succeeding scanning signal or image signal, the image signal at the time of application to the pixel results in difference from the prescribed amount.

As mentioned above, when the number of pixels is increased and at the same time the size of screen is enlarged, there arises crosstalk which shows variation in the brightness of the pixels surrounding the pattern and defective display such as flicker in which the brightness of the pixels around the pattern varies at times, and the quality of display is remarkably lowered.

With respect to the driving method for the LCD device in consideration of the prevention of degradation of display quality, there is an alternating current driving method. The alternating current driving method is a method of driving the LCD device while inverting (changing) the polarity of the image signal in a predetermined cycle period. In the present specification, the polarity of the signal means the polarity of the voltage of the signal.

In case of adopting the alternating current drive method, in general, the polarity of the output from the odd number from the image drive (hereinafter referred to simply as "odd number output") is different from the polarity of the output from the even number from the image drive (hereinafter referred to as "even number output"). In order to change the polarity of the odd number output from the polarity of the even number output, a drive circuit for outputting the polarity inversion signal capable of optionally inverting the polarity (hereinafter to be referred to as "polarity inverting drive circuit") is provided, for example, in the timing control circuit.

FIG. 12 is an illustrative view showing an example of conventional liquid crystal drive circuit. In FIG. 12, the part 1 shows a liquid crystal drive circuit, and 101 to 106 show the output terminals of the liquid crystal drive circuit 1. In FIG. 12, there are shown only six output terminals of the liquid crystal drive circuit 1. The first output terminal, third output terminal and (2 m+1)-th output terminal denoted by numerals 101, 103 and 105 are the odd number output terminals to output the odd number outputs. Furthermore, the second output terminal, fourth output terminal and (2 m+2)-th output terminal denoted by numerals 102, 104 and 106 are the odd number output terminals to output the odd number outputs, wherein m is 0 (Zero) or natural number.

FIG. 13 is an illustrative view showing the polarity inversion signal, and examples of the polarities of the odd number output and even number output outputted from the liquid crystal drive circuit shown in FIG. 12. In FIG. 13, there are shown from the top the polarities of polarity inversion signal, odd number output, and even number output. In FIG. 13, the horizontal direction shows time, and the vertical direction shows voltage with respect to the polarity inversion signal only.

In FIG. 13, when the polarity inversion signal is in high level, the polarity of the odd number output is positive, and when the polarity inversion signal is in low level, the polarity of the odd number output is negative, and the polarity of the even number output is negative.

FIGS. 14(*a*) and 14(*b*) and FIGS. 15(*a*) and 15(*b*) are the illustrative views showing an example of the concept of the line relating to the pixels of the conventional LCD panel. FIG. 14(*a*) is an illustrative view showing an LCD device in n frame (n is 0 (Zero) or natural number), and FIG. 14(b) is an illustrative view showing an LCD device in n+1 frame. FIG. 15(*a*) is an illustrative view showing an LCD device in n+2 frame, and FIG. 15(*b*) is an illustrative view showing an LCD device in n+3 frame.

In FIGS. 14(*a*) and 14(*b*) and FIGS. 15(*a*) and 15(*b*), the part 1*a* shows an upper liquid crystal drive circuit provided on the upper side of the LCD panel, numeral 1*b* shows a lower liquid crystal drive circuit provided on the under side of the LCD panel, numeral 2 shows a scanning signal circuit, and numeral 4 shows a timing control circuit for controlling the timing for varying the voltage of the signal outputted from the upper liquid crystal drive circuit 1*a*, lower liquid crystal drive circuit 1*b*, and scanning signal circuit 2 to the predetermined amounts. Furthermore, numeral 11*a* shows an image signal line connected to the output terminal of the upper liquid crystal drive circuit 1*a*, 11*b* shows an image signal line connected to the output terminal of the lower liquid crystal drive circuit 1*b*, and numeral 12 shows a scanning signal line connected to the output terminal of the scanning signal circuit 2. The symbol "+" or "−" shown in the white circle schematically shows the polarity, i.e., positive or negative, of the image signal to be applied to the pixel. Furthermore, the upper image signal line 11*a* and image signal line 11*b* labeling "R" are the signal lines dealing with the pixels for red color, the upper image signal line 11*a* and lower image signal line 11*b* labeling "G" are the signal lines dealing with the pixels for green color, and the upper image signal line 11*a* and lower image signal line 11*b* labeling "B" are the signal lines dealing with the pixels for blue color, respectively.

The LCD device comprises an LCD panel, an upper liquid crystal drive circuit 1*a*, a lower liquid crystal drive circuit 1*b*, a scanning signal circuit 2, an upper liquid crystal drive circuit 1*a*, a lower liquid crystal drive circuit 1*b*, and a timing control circuit 4 for controlling the timing for varying the voltage of the signal outputted from the scanning signal circuit 2 to a predetermined voltage. The above LCD panel comprises an upper image signal line 11*a*, a lower image signal line 11*b* and a scanning signal line 12, pixels disposed in matrix with the boundary lines of the upper image signal line 11*a*, lower image signal line 11*b* and scanning signal line 12, and TFTs (not illustrated) provided at each cross point of the upper image signal line 11*a* and scanning signal line 12 and at each cross point of the lower image signal line 11*b* and scanning signal line 12.

FIGS. 16(*a*) to 16(*c*) and FIGS. 17(*a*) and 17(*b*) are timing charts showing the signals to be used for driving the LCD devices shown in FIGS. 14(*a*) and 14(*b*) and FIGS. 15(*a*) and 15(*b*). In FIGS. 16(*a*) to 16(*c*) and FIGS. 17(*a*) and 17(*b*), the abscissa shows the time, and the ordinate shows the voltage.

In FIG. 16(*a*) there are shown from the top switching timing signal for the first polarity inversion signal and switching timing signal for the second polarity inversion signal. The signals are continued in order of, for example, n frame, (n+1) frame, . . . , wherein a shows the time of change to n frame, b the time of change to (n+1) frame, c the time of change to (n+2) frame, and d the time of change to (n+3) frame.

In FIG. 16(*b*), there are shown from the top the first polarity inversion signal and the second polarity inversion signal in n frame. In FIG. 16(*c*), there are shown from the top the first polarity inversion signal and the second polarity inversion signal in (n+1) frame. In FIG. 17(*a*), there are shown from the top the first polarity inversion signal and the second polarity inversion signal in (n+2) frame. In FIG. 17(*b*), there are shown from the top the first polarity inversion signal and the second polarity inversion signal in (n+3) frame. The points $a_1$, $b_1$, $c_1$, and $d_1$ show the time when the first scanning signal line is selected in one frame (i.e., when the first line is selected in each frame). The points $a_2$, $b_2$, $c_2$, and $d_2$ show the time when the second scanning signal line is selected in one frame. The points $a_3$, $b_3$, $c_3$, and $d_3$ show the time when the second scanning signal line is selected in one frame. The points $a_3$, $b_3$, $c_3$, and $d_3$ show the time when the third scanning signal line is selected in one frame. The points $a_4$, $b_4$, $c_4$, and $d_4$ show the time when the fourth scanning signal line is selected in one frame. The points $a_5$, $b_5$, $c_5$, and $d_5$ show the time when the fifth scanning signal line is selected in one frame.

The first polarity inversion signal is a signal for controlling the polarity of the image signal to be applied to the pixel through the upper image signal line (hereinafter to be referred to as "upper image signal"). On the other hand, the second polarity inversion signal is a signal for controlling the polarity of the image signal to be applied to the pixel through the lower image signal line (hereinafter to be referred to as "lower image signal"). The switching timing signal for the first polarity inversion signal is a signal for controlling the polarity of the first polarity inversion signal in $a_1$, $b_1$, $c_1$ or $d_1$, and the switching timing signal for the second polarity inversion signal is a signal for controlling the polarity of the second polarity inversion signal in $a_1$, $b_1$, $c_1$ or $d_1$. The polarities of the first polarity inversion signal and the second polarity inversion signal vary in the predetermined patterns in one frame. For example, in FIG. 16(*b*), FIG. 16(*c*), FIG. 17(*a*) and FIG. 17(*b*), the polarity is inverted when the scanning signal line of the first, third, fourth, or fifth is selected in each frame. Whether the polarity inverts from the high level to the low level or inverts from the low level to the high level depends on the polarities of the first polarity inversion signal and the second polarity inversion signal in $a_1$, $b_1$, $c_1$ and $d_1$.

The output terminal of the upper liquid crystal drive circuit 1*a* is connected to the image signal line in the odd number counted from the left side (hereinafter to be referred to as "upper image signal line") 11*a*. Also, the output terminal of the lower liquid crystal drive circuit 1*b* is connected to the image signal line in the even number order counted from the left side (hereinafter to be referred to as "lower image signal line") 11*b* (referring to FIGS. 14(*a*) and 14(*b*) and FIGS. 15(*a*) and 15(*b*)).

In the conventional LCD device driving method, the polarities of the first polarity inversion signal and the second inversion signal are inverted in selecting the scanning signal line of the first by frame, so that the image signals of the same polarity are not always applied to the liquid crystals of each pixel (referring to FIG. 16(*a*)).

In the conventional method for driving LCD device, the polarities of the first polarity inversion signal and the second inversion signal are inverted in selecting the scanning signal line of the first by frame, by the switching timing signal for the first polarity inversion signal and the switching timing signal for the second polarity inversion signal. However, in case of classifying into groups by the pixel to which the image signals of the same polarity are applied, the pixels which constitute each group do not change even when the frame is changed. Consequently, an electric field is generated in horizontal direction (in the direction parallel with the plane including the scanning signal line and image signal line) between the adjacent groups. In the area in which the horizontal electric field has been generated, no predetermined image is obtainable, and the display quality is degraded. Generation of electric field in the horizontal direction is not visually recognized if it is thinned by frame, but in the conventional case under review in which the voltages in the horizontal direction are generated between the frames in the same place at all times, there is a problem of high possibility for the electric field to be visually recognized.

The present invention has been made to solve the problems as above, and object of the present invention is to provide a driving method for an LCD device comprising a large size, high resolution color LCD panel, in which the display quality can be improved.

SUMMARY OF THE INVENTION

One aspect of the present invention is directed to method for driving an LCD device comprising steps of:

applying one of upper image signal outputted from an upper liquid crystal drive circuit and lower image signal outputted from a lower liquid crystal drive circuit to a plurality of pixels of a selected line by scanning signal outputted from a scanning signal circuit out of the plurality of pixels disposed in matrix to display a predetermined image;

wherein there exist in mixture a case where the polarities of the upper image signal and the lower image signal are inverted every one vertical period and a case where the same polarity is maintained.

Another aspect of the present invention is directed to method for driving an LCD device comprising steps of:

applying one of upper image signal outputted from an upper liquid crystal drive circuit and lower image signal outputted from a lower liquid crystal drive circuit to a plurality of pixels of selected line by scanning signal outputted from a scanning signal circuit out of a plurality of pixels disposed in matrix to display a predetermined image;

wherein, in selecting a first line in each frame, polarities of the upper image signal and the lower image signal are changed every two frames, and the timing for changing the polarity of the upper image signal is displaced at the rate of one frame to the timing for changing the polarity of the lower image signal.

Another aspect of the present invention is directed to a driving circuit for LCD device comprising at least an upper liquid crystal drive circuit, a lower liquid crystal drive circuit, a scanning signal circuit, a timing control circuit and a vertical synchronization signal converting circuit, said vertical synchronization signal converting circuit being a drive circuit of LCD for outputting a switching timing signal for a first polarity inversion signal and a switching timing signal for a second polarity inversion signal, wherein said switching timing signal for a first polarity inversion signal and said switching timing signal for a second polarity inversion signal are outputted by said vertical synchronization signal converting circuit such that in n frame polarity of a first polarity inversion signal inputted to said upper liquid crystal drive circuit is made inverted to polarity of a second polarity inversion signal inputted to said lower liquid crystal drive circuit; and in n+1 frame said polarity of a first polarity inversion signal inputted to said upper liquid crystal drive circuit is made inverted to said polarity of a second polarity inversion signal inputted to said lower liquid crystal drive circuit.

BRIEF EXPLANATION OF THE DRAWINGS

FIGS. 5(*a*) to 5(*f*) are illustrative views showing output waveforms of Embodiment 1 of the LCD device of the present invention.

DETAILED DESCRIPTION

Figure 1:
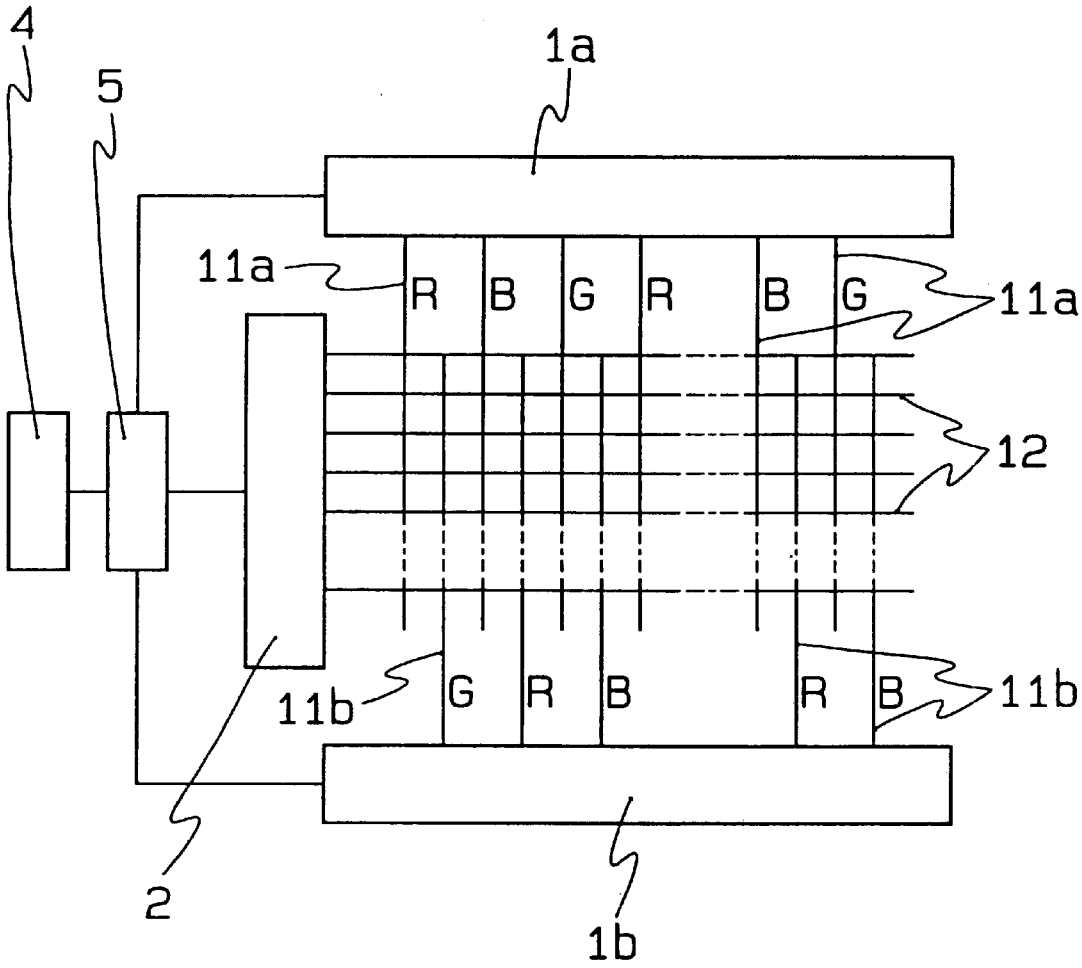
FIG. 1 is an illustrative view showing an example of the concept of the line relating to the pixels of the LCD panel to be driven by using the driving method of the LCD device of the present invention.

Next, the embodiments of the driving method of the LCD device of the present invention is explained.

Embodiment 1

Referring to the drawings, Embodiment 1 of the driving method of the LCD device of the present invention is explained.

In this embodiment, there exist in mixture in each frame the case where the polarities of the upper image signal and the lower image signal are inverted in the unit of one vertical period and the case where the same polarity is maintained. Of the plural pixels constituting the lines selected by the scanning signal, the alternate pixels may have application of the upper image signal, and the rest of the pixels may have application of the lower image signal. Furthermore, the alternate pixels may be the pixels of odd number, and the rest of pixels may be the pixels of even number.

Figure 14A:
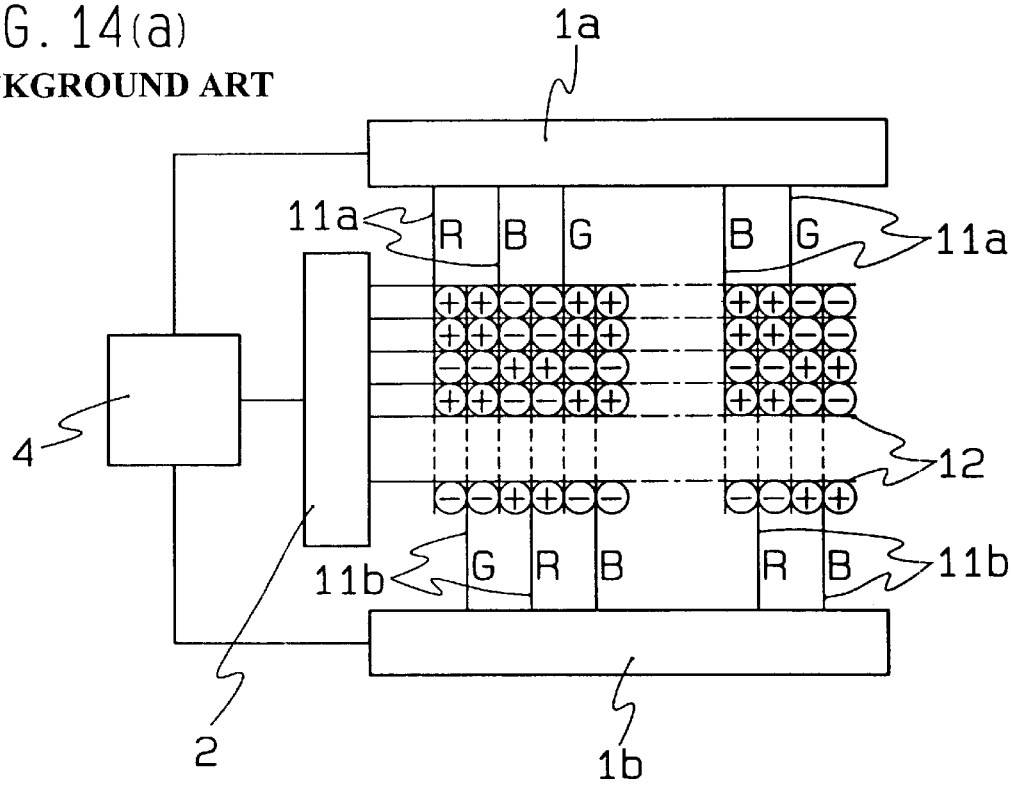
FIG. 14(a) BACKGROUND ART
FIGS. 14(*a*) and 14(*b*) are illustrative views showing an example of the concept of the line relating to the pixels of the conventional LCD device.
Figure 14B:
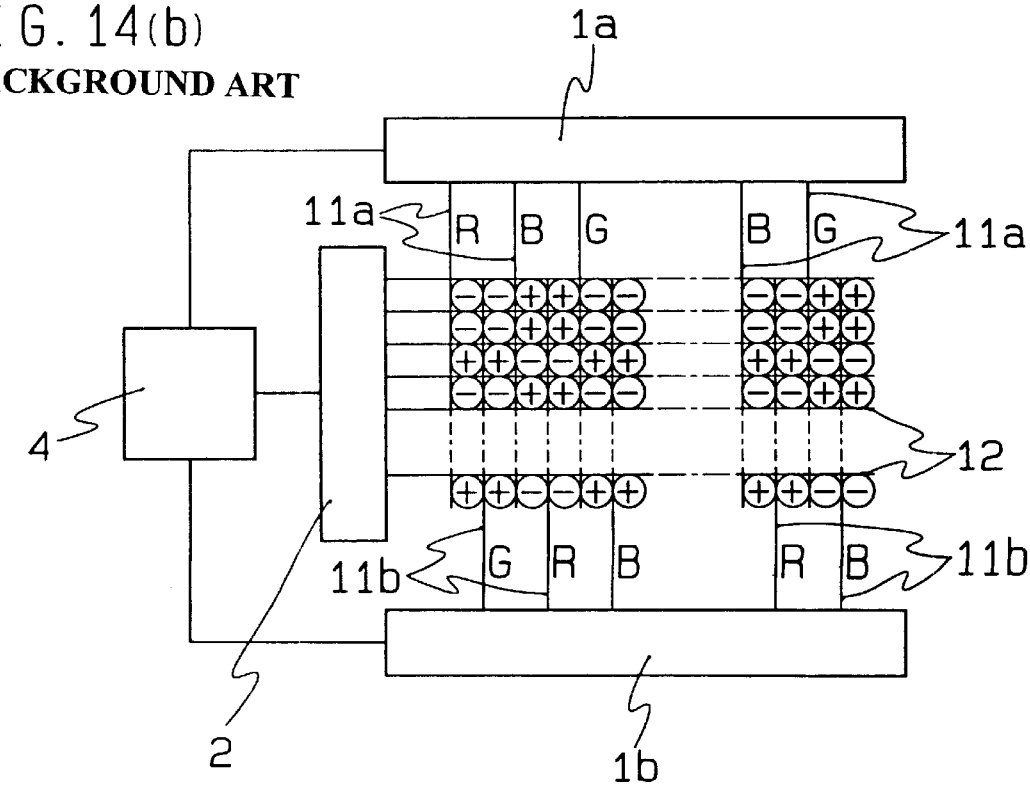
FIG. 14(b) BACKGROUND ART

FIG. 1 is an illustrative view showing an example of the concept of the line relating to the pixels of the LCD device to be driven by using the driving method of the liquid crystal device of the present invention. In FIG. 1, numeral 5 shows a vertical synchronization signal converting circuit and the same parts as those of FIGS. 14(*a*) and 14(*b*) are shown by using the same numbers. In order to output the first polarity inversion signal and the second polarity inversion signal both relating to the method for driving an LCD device of the present invention, a vertical synchronization signal converting circuit for outputting a switching timing signal for the first polarity inversion signal and a switching timing signal for the second polarity inversion signal by converting from a vertical synchronization signal is provided to the next stage of the timing control circuit. The vertical synchronization signal converting circuit 5 relating to Embodiment 1 is composed such that, as described below, there exist in mixture a case where the polarites of the upper image signal and the lower image signal are inverted every one vertical period and a case where the same polarity is maintained in each frame. Further, the constitution elements of the LCD device shown in FIG. 1 are the same as those of the conventional LCD device.

As shown in FIG. 1, an image signal is applied to the pixel of the odd number order counted from the left side by the upper image signal line 11*a*, and an image signal is applied to the pixel of the even number counted from the left side by the lower image signal line 11*b*. However, this is an example. It may be so practiced for example that an image signal is applied to the pixel of the even number by the upper image signal line 11*a*, and an image signal is applied to the pixel of the odd number order counted from the left side by the lower image signal line 11*b*.

Figure 2A:
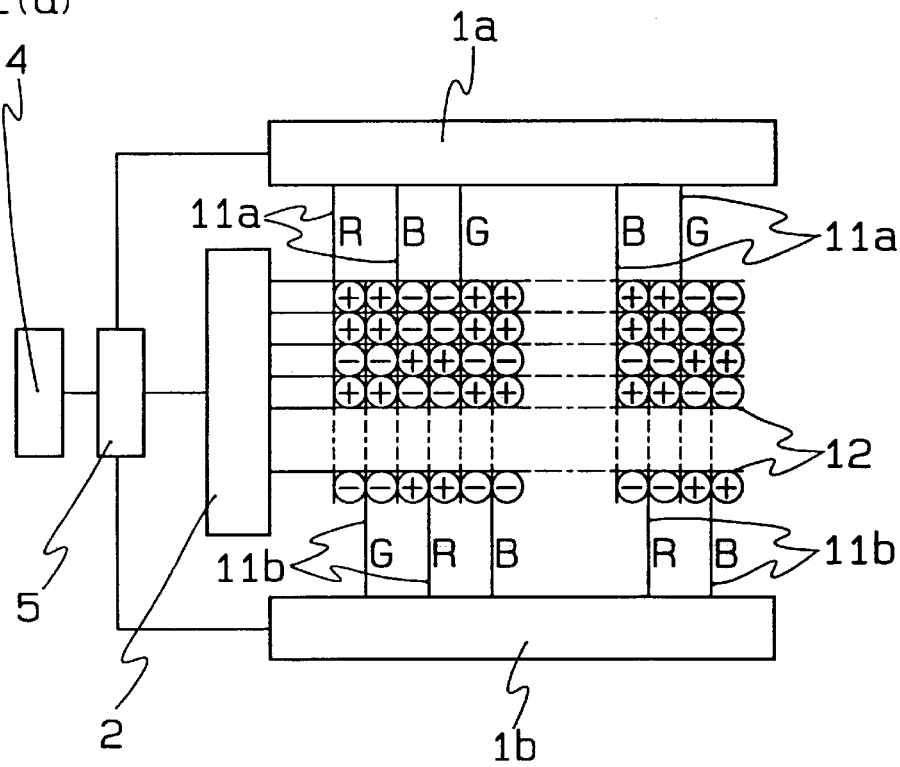
FIGS. 2(*a*) and 2(*b*) are illustrative views showing an example of the concept of the line relating to the pixels of the LCD panel to be driven by using Embodiment 1 of the driving method of the LCD device of the present invention.
Figure 2B:
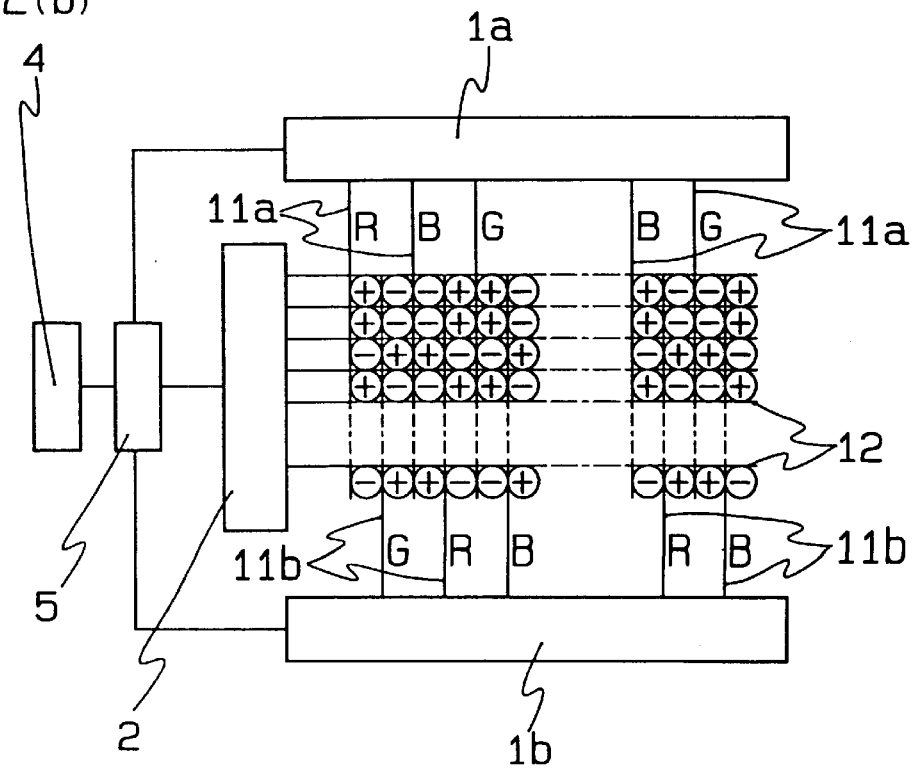

FIGS. 2(*a*) and 2(*b*) are illustrative views showing an example of the concept of line concerning the pixel of the panel of the LCD device to be driven by using Embodiment 1 of the driving method of the LCD device of the present invention. The essential elements of the LCD device shown in FIGS. 2(*a*) and 2(*b*) are the same as those of the conventional LCD device, and in FIGS. 2(*a*) and 2(*b*) the same parts as those of FIGS. 14(*a*) and 14(*b*) are shown by using the same numbers. FIGS. 2(*a*) is an illustrative view showing the LCD device in n frame, and FIG. 2(*b*) is an illustrative view showing the LCD device in (n+1) frame.

Figure 3A:
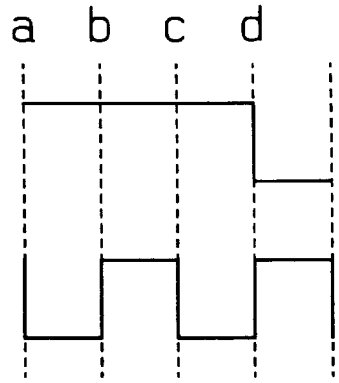
FIGS. 3(*a*) to 3(*c*) are timing charts showing a signal to be used for driving the LCD device shown in FIGS. 2(*a*) and 2(*b*).
Figure 3B:
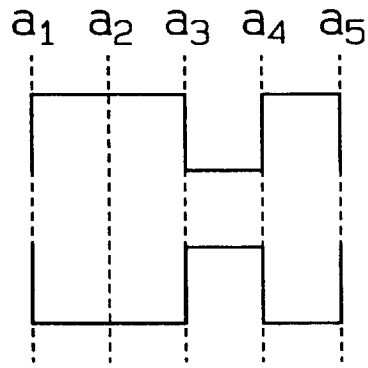
Figure 3C:
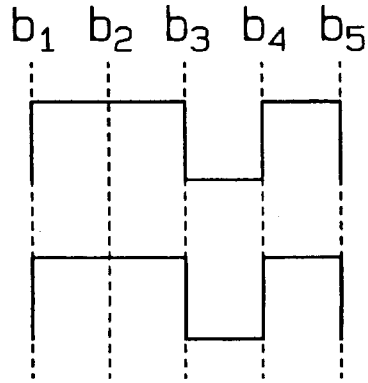
Figure 16A:
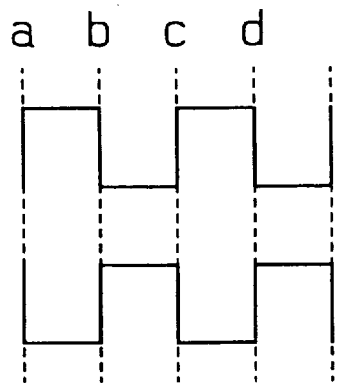
FIG. 16(a) BACKGROUND ART
FIGS. 16(*a*) to 16(*c*) are timing charts showing the signal to be used for driving the LCD device shown in FIGS. 14(*a*) and 14(*b*) and FIGS. 15(*a*) and 15(*b*).
Figure 16B:
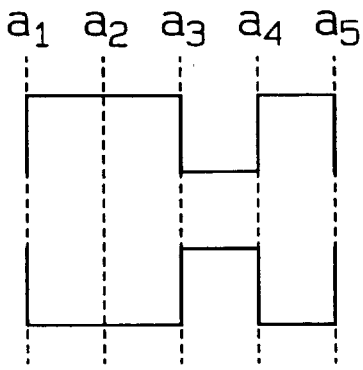
FIG. 16(b) BACKGROUND ART
Figure 16C:
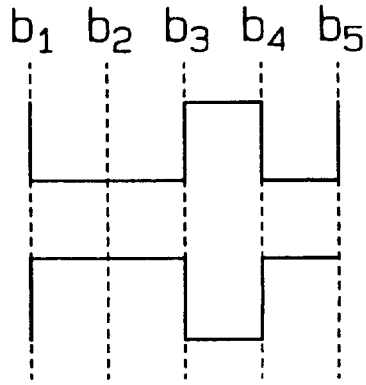
FIG. 16(c) BACKGROUND ART

FIGS. 3(*a*) to 3(*c*) are timing charts showing a signal to be used for driving the LCD device shown in FIGS. 2(*a*) and 2(*b*). In FIGS. 3(*a*) to 3(*c*), the same parts as those of FIGS. 16(*a*) to 16(*c*) are shown by using the same numerals. In FIG. 3(*a*), there are shown from above the switching timing signal for the first polarity inversion signal and the switching timing signal for the second polarity inversion signal. In FIG. 3(*b*), there are shown from above the first polarity inversion signal and the second polarity inversion signal in n frame. In FIG. 3(*c*), there are shown from above the first polarity inversion signal and the second polarity inversion signal in (n+1) frame.

In case of n a frame, the polarity of the first polarity inversion signal inputted to the upper LCD circuit is in inverse polarity to the polarity of the second polarity inversion signal inputted to the lower liquid crystal drive circuit (referring to FIG. 2(*b*)). Accordingly, those in which the polarities of the image signals applied to the pixel (upper image signal or lower image signal) become the same between the adjacent pixels in a direction parallel to the scanning signal line 12 are the first row pixel with the second row pixel, and third row pixel with the fourth row pixel (referring to FIG. 2(*a*)). That is, the polarities of the upper image signal and the lower image signal keep the same polarity for one vertical period, so that the pixels on the (2p+1)-th row and the pixels on the (2p+2)-th row become the same polarity. The above one vertical period means a period to scan the pixels of one row portion, for example, the pixels of the first row and the second row. The symbol p shows 0 (Zero) or natural number.

Further, in case of (n+1) frame, the polarity of the first polarity inversion signal inputted to the upper liquid crystal drive circuit is in the same polarity to the polarity of the second polarity inversion signal inputted to the lower liquid crystal drive circuit referring to FIG. 3(*c*)). Accordingly, those in which the polarities of the image signals applied to the pixel (upper image signal or lower image signal) become the same between the adjacent pixels in a direction parallel to the scanning signal line 12 are the second row pixel with the third row pixel, and fourth row pixel with the fifth row pixel (referring to FIG. 2(*b*)). That is, the polarities of the upper image signal and the lower image signal invert for one vertical period, so that the pixels on the (2p+2)-th row and the pixels on the (2p+3)-th row become the same polarity, being different from the case of n frame.

Figure 4:
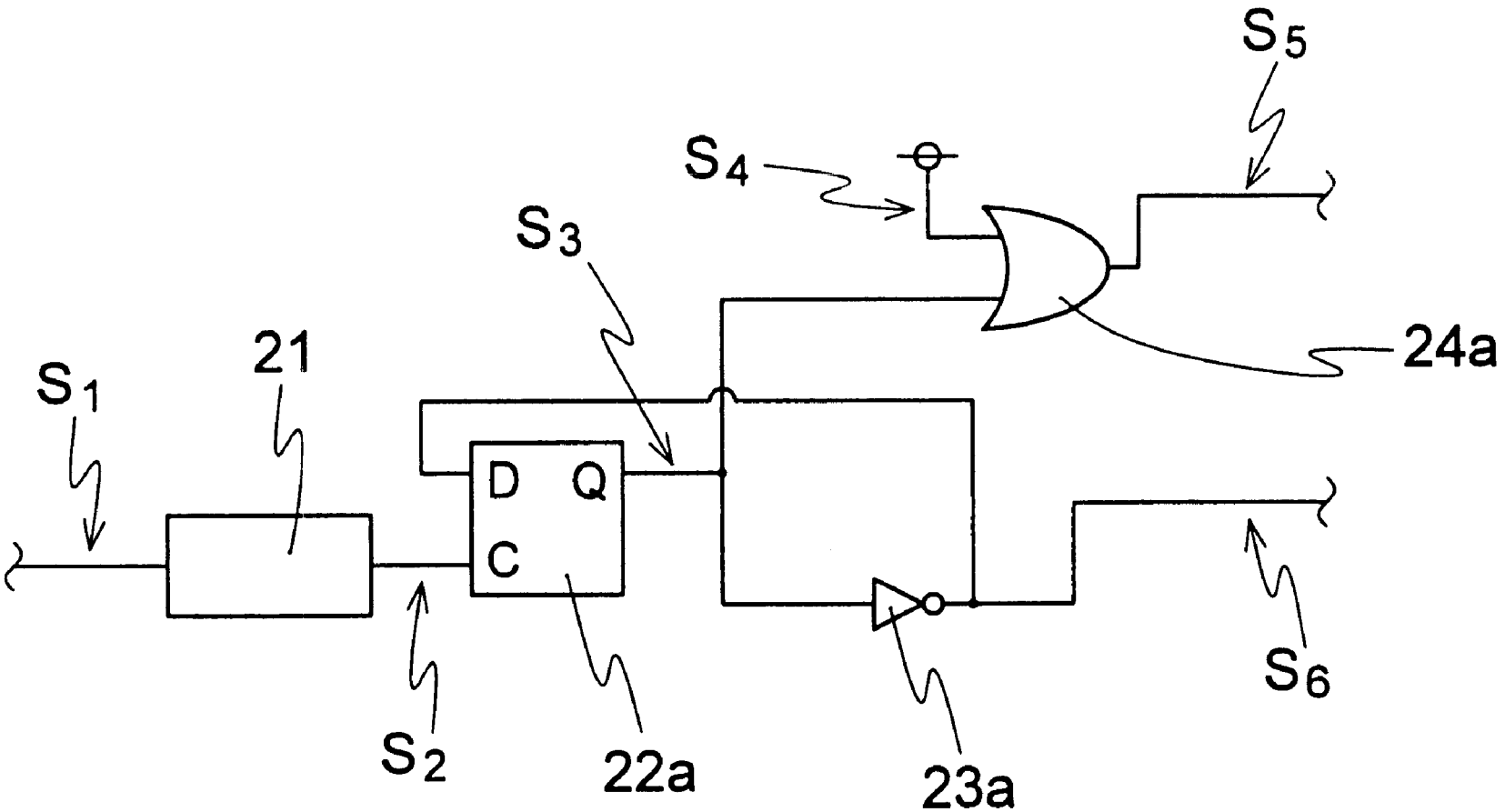
FIG. 4 is a block diagram illustrating a vertical synchronization signal converting circuit of Embodiment 1 of the LCD device of the present invention.

Accordingly, when classification is made by the pixel to which the image signals of the same polarity are applied and the odd number frame is compared with the even number frame, the pixels constituting the group vary by frame. When the frame varies, the pixels constituting each group vary. As a result, it becomes possible to average the horizontal direction electric fields spatially, by which the display defect attributed to the horizontal electric field is not visibly noticed, and the display quality can be improved. The vertical synchronization signal converting circuit 5 for outputting such first polarity inversion signal and second polarity inversion signal is explained below. FIG. 4 is a block diagram illustrating detailed composition of the vertical synchronization signal converting circuit; and FIGS. 5(*a*) to 5(*f*) are illustrative views showing output waveforms. In FIG. 4, numeral 21 shows a differential circuit; 22*a* shows flip-flop; and 23*a* shows a NOT circuit respectively. Vertical synchronization signal $S_1$ is shown in FIG. 5(*a*). The vertical synchronization signal is converted through the differential circuit 21 to timing signal $S_2$ the one cyclic period of which is a vertical period shown as VD in FIG. 5(*a*). Next, the timing signal $S_2$ is converted through flip-flop 22*a* to a signal $S_3$ the waveform of which is shown in FIG. 5(*c*); and then the signal $S_3$ is divided for the first polarity inversion signal line and the second polarity inversion signal line to obtain switching timing signal $S_5$ (shown in FIG. 5(*e*) for the first polarity inversion signal through OR circuit 24*a* and to obtain switching timing signal $S_6$ (shown in FIG. 5(*f*)) though NOT circuit 23*a*.

Embodiment 2

Next, referring to the drawings, Embodiment 2 of the driving method of the LCD device of the present invention is explained.

In this embodiment, in selecting the first line in each frame, the polarities of the upper image signal and the lower image signal are switched every two frames, and the timing for switching the polarity of the upper image signal is displaced by one frame to the timing of switching the polarity of the lower image signal.

Figure 6A:
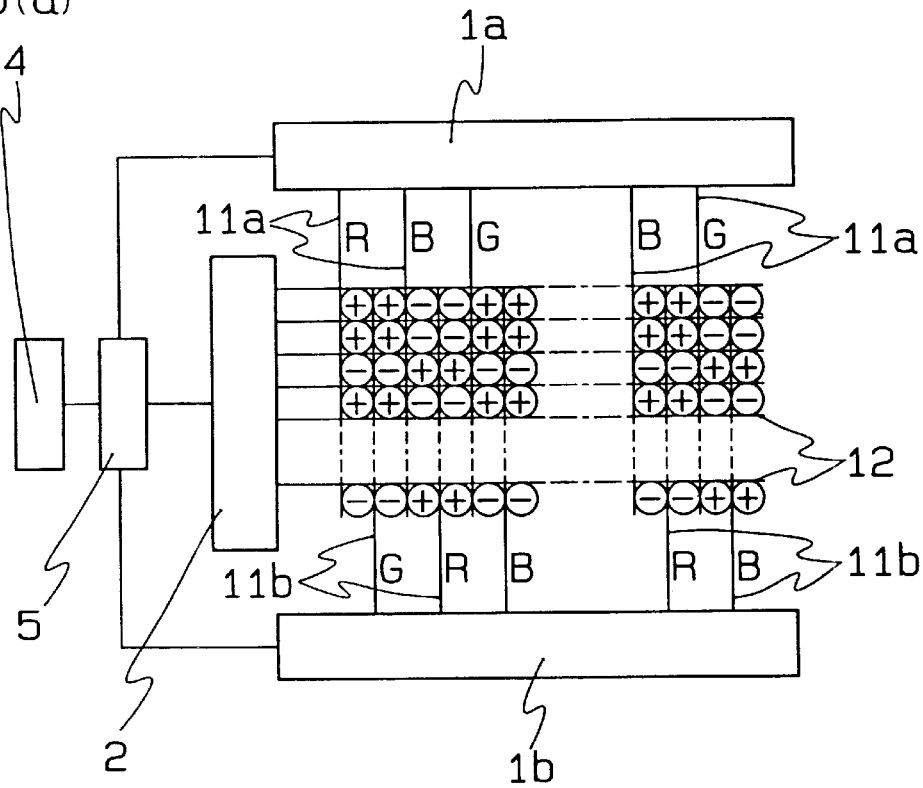
FIGS. 6(*a*) and 6(*b*) are illustrative views LCD showing an example of the concept of the line relating to the pixels of the LCD panel to be driven by using Embodiment 2 of the driving method of the LCD device of the present invention.
Figure 6B:
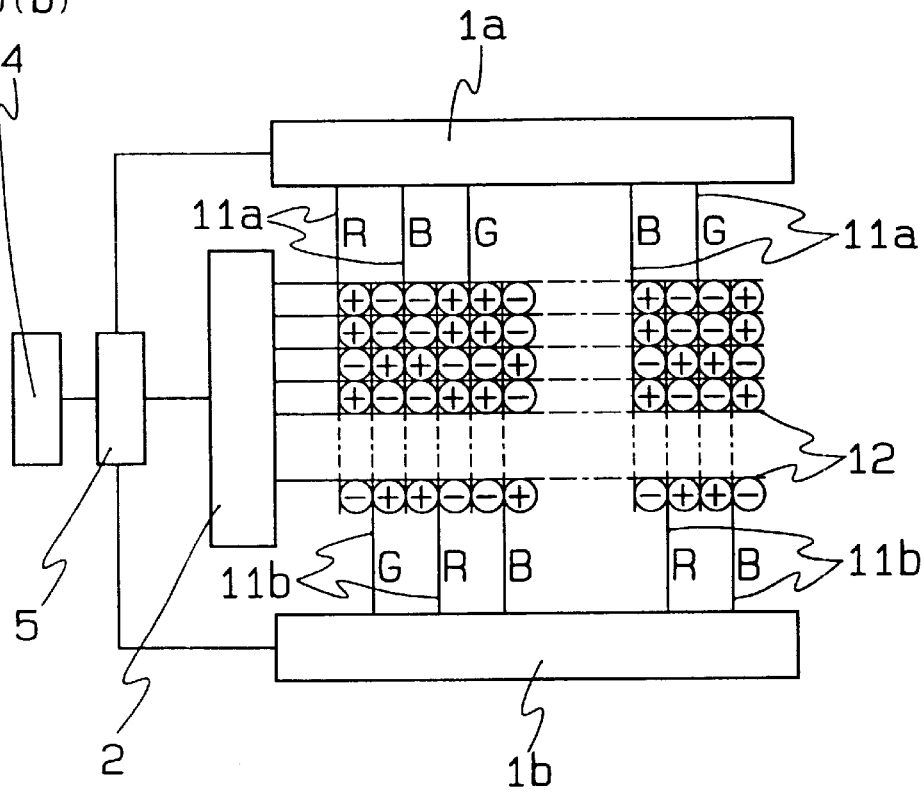
Figure 7A:
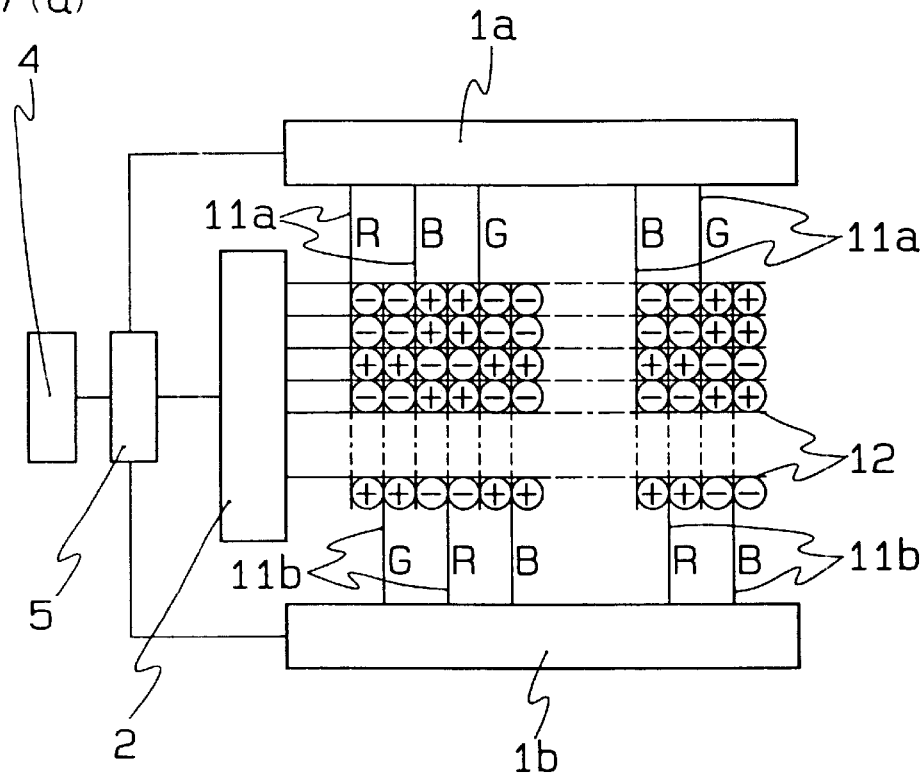
FIGS. 7(*a*) and 7(*b*) are illustrative views showing an example of the concept of the line relating to the pixels of the LCD panel to be driven by using Embodiment 2 of the driving method of the LCD device of the present invention.
Figure 7B:
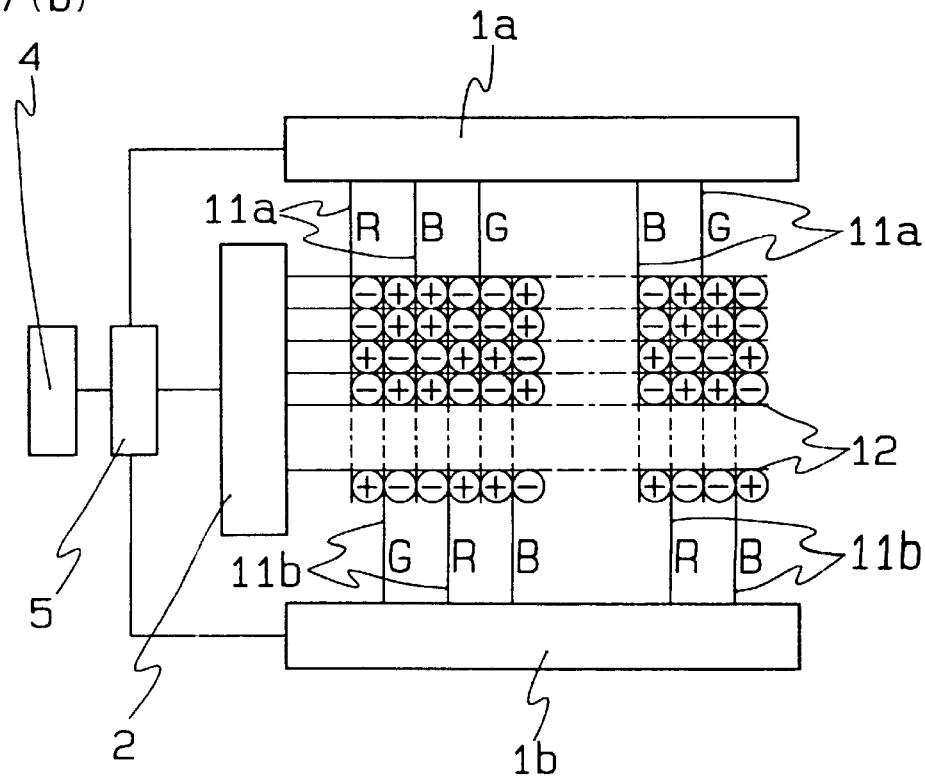
Figure 15A:
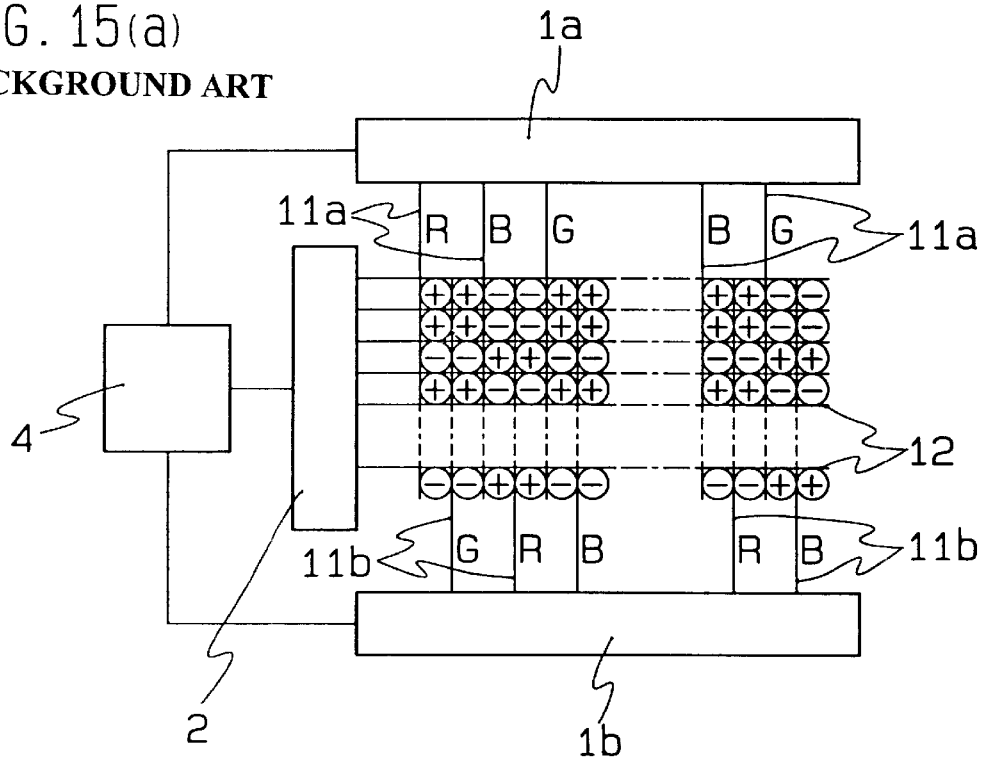
FIG. 15(a) BACKGROUND ART
FIGS. 15(*a*) and 15(*b*) are illustrative views showing an example of the concept of the line relating to the pixels of the conventional LCD device.
Figure 15B:
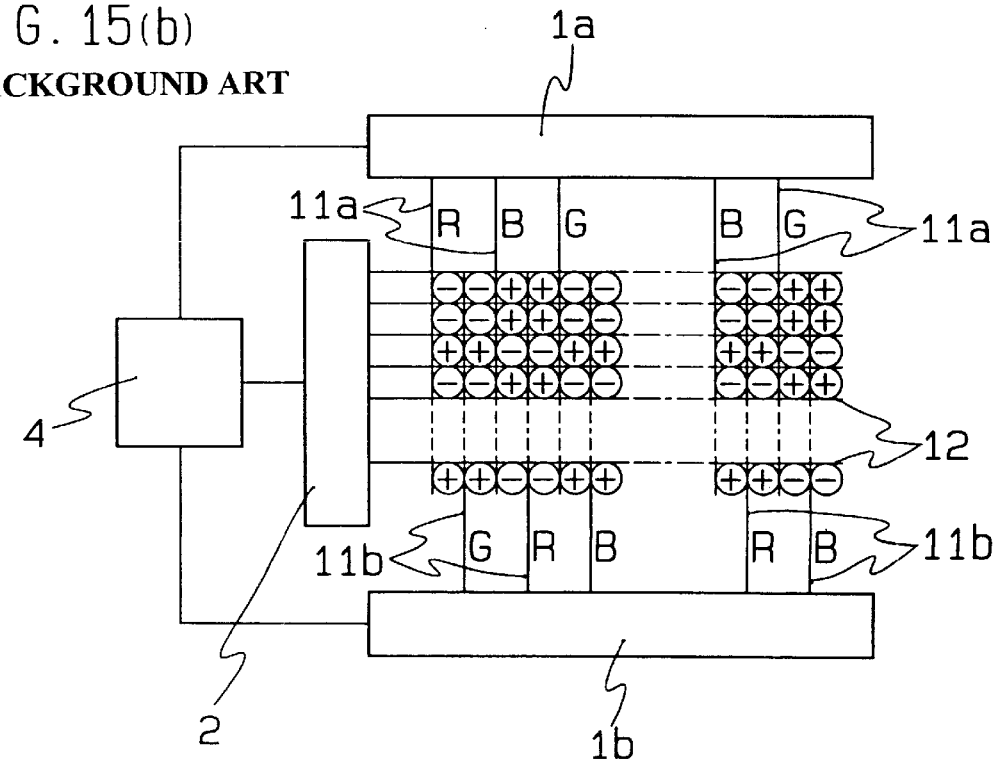
FIG. 15(b) BACKGROUND ART

FIGS. 6(*a*) and 6(*b*) and FIGS. 7(*a*) and 7(*b*) are the illustrative views showing an example of the concept of the line relating to the pixels of the LCD device to be driven by using Embodiment 2 of the driving method of the LCD device of the present invention. The essential elements of the LCD device shown in FIGS. 6(*a*) and 6(*b*) and FIGS. 7(*a*) and 7(*b*) are same as those of the conventional LCD device. In FIGS. 6(*a*) and 6(*b*) and FIGS. 7(*a*) and 7(*b*), the same places as those of FIGS. 14(*a*) and 14(*b*) and FIGS. 15(*a*) and 15(*b*) are shown by using the same marks. FIG. 6(*a*) is an illustrative view showing the LCD device in n frame, and FIG. 6(*b*) is an illustrative view showing the LCD device in (n+1) frame. Further, FIG. 7(*a*) is an illustrative view showing the LCD device in (n+2) frame, and FIG. 7(*b*) is an illustrative view showing the LCD device in (n+3) frame.

Figure 8:
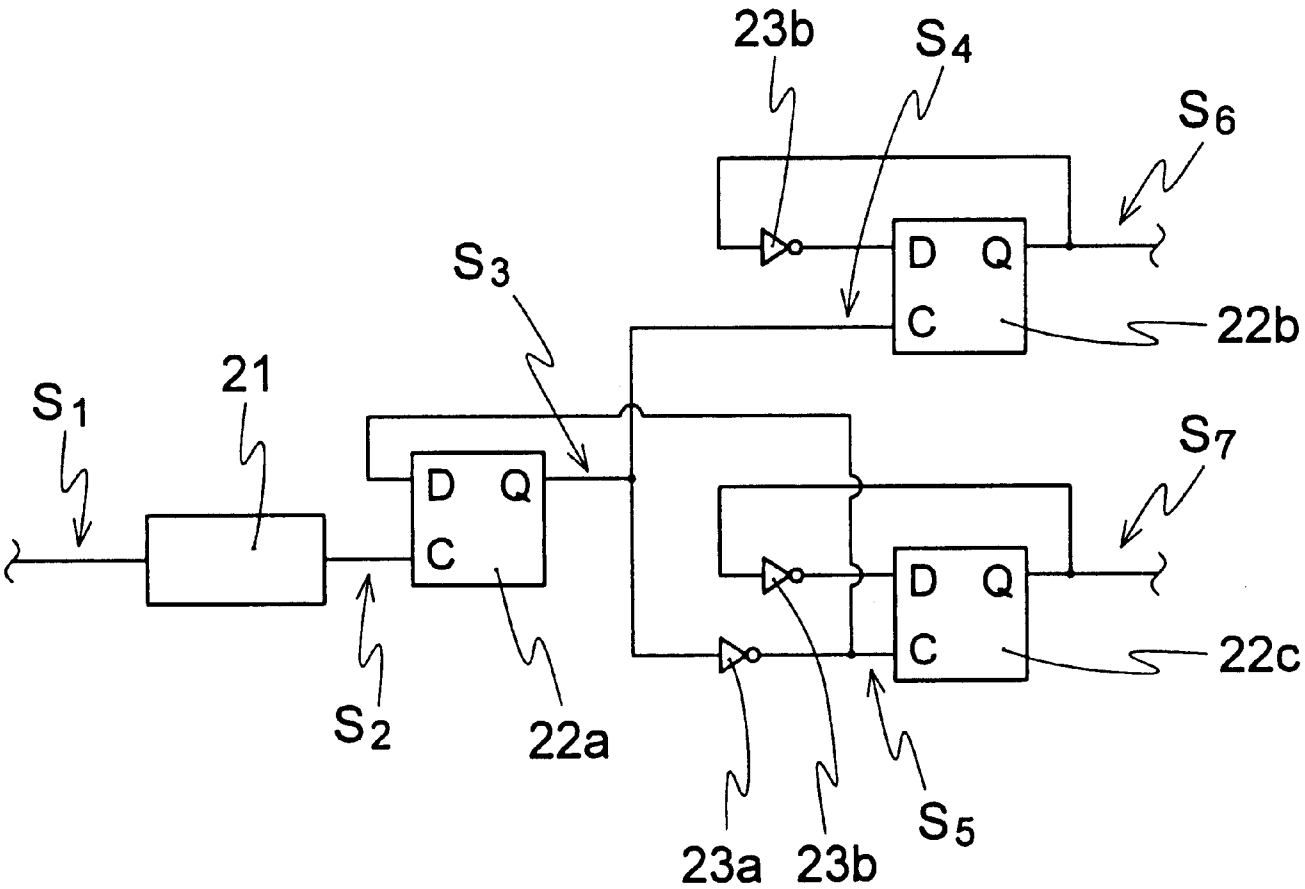
FIG. 8 is a block diagram illustrating a vertical synchronization signal converting circuit of Embodiment 2 of the LCD device of the present invention FIGS. 9(*a*) to 9(*g*) are illustrative views showing output waveforms of Embodiment 2 of the LCD device of the present invention.

FIG. 8 is a block diagram illustrating detailed composition of the vertical synchronization signal converting circuit; and FIGS. 9(*a*) to 9(*g*) are illustrative views showing output waveforms. In Embodiment 2, the circuit shown in FIG. 4 is changed and a circuit shown in FIG. 8 and waveforms shown in FIGS. 9(*a*) to 9(*g*) are used. In FIG. 8, numerals 22*b* and 22*c* show flip-flops and 23*a* and 23*b* show NOT gates. The circuit shown in FIG. 8 is composed such that in selecting the first line in each frame, the polarities of the upper image signal and the lower image signal can be switched every two frames, and the timing for switching the polarity of the upper image signal is displaced by one frame to the timing of switching the polarity of the lower image signal. Thus, vertical synchronization signal $S_1$ to be inputted to differential circuit 21 is shown in FIG. 9(*a*); and the vertical synchronization signal $S_1$ is converted through differential circuit 21 to a timing signal $S_2$ the one cyclic period of which is a vertical period shown as VD in FIG. 9(*a*). Next, the timing signal $S_2$ is converted through flip-flop 22*a* to a signal $S_3$ the waveform of which is shown in FIG. 9 (*c*); and then the signal $S_3$ is divided for the first polarity inversion signal line and the second polarity inversion signal line to obtain switching timing signal $S_6$ (shown in FIG. 9(*e*)) for the first polarity inversion signal through flip-flop 22*b* from signal $S_4$ and to obtain switching timing signal $S_7$ (shown in FIG. 9(*g*)) for the second polarity inversion signal through flip-flop 22*c* from signal $S_5$, respectively.

Figure 10A:
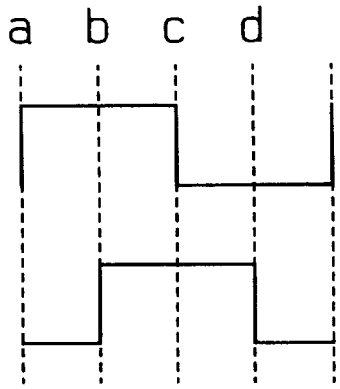
FIGS. 10(*a*) to 10(*c*) are timing charts showing a signal to be used for driving the LCD devices shown in FIGS. 6(*a*) and 6(*b*) and FIGS. 7(*a*) and 7(*b*).
Figure 10B:
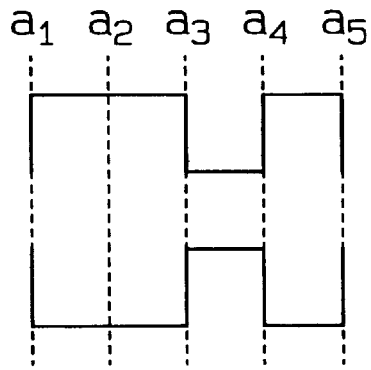
Figure 10C:
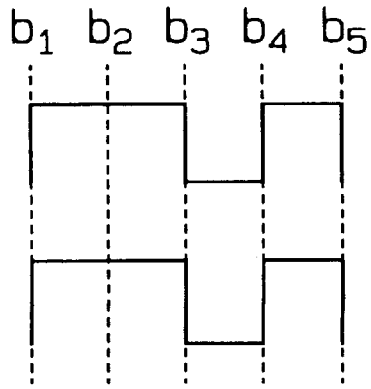
Figure 11A:
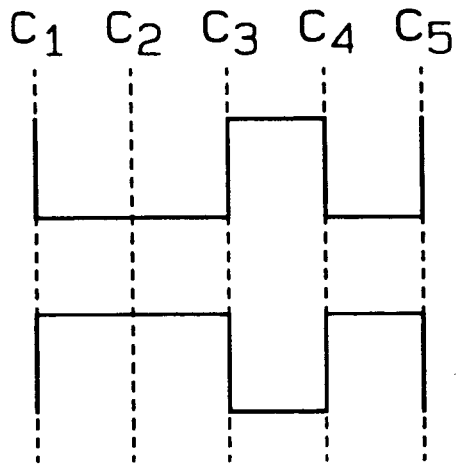
FIGS. 11(*a*) and 11(*b*) are timing charts showing a signal to be used for driving the LCD device shown in FIGS. 7(*a*) and 7(*b*).
Figure 11B:
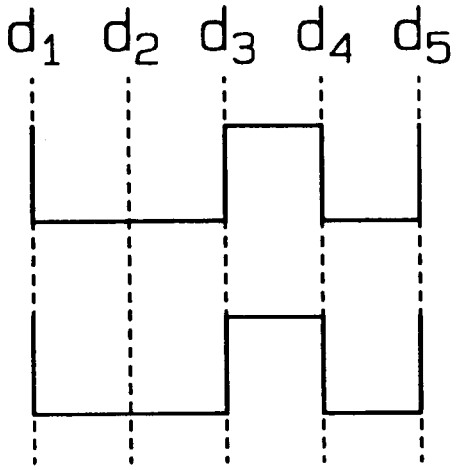
Figure 12:
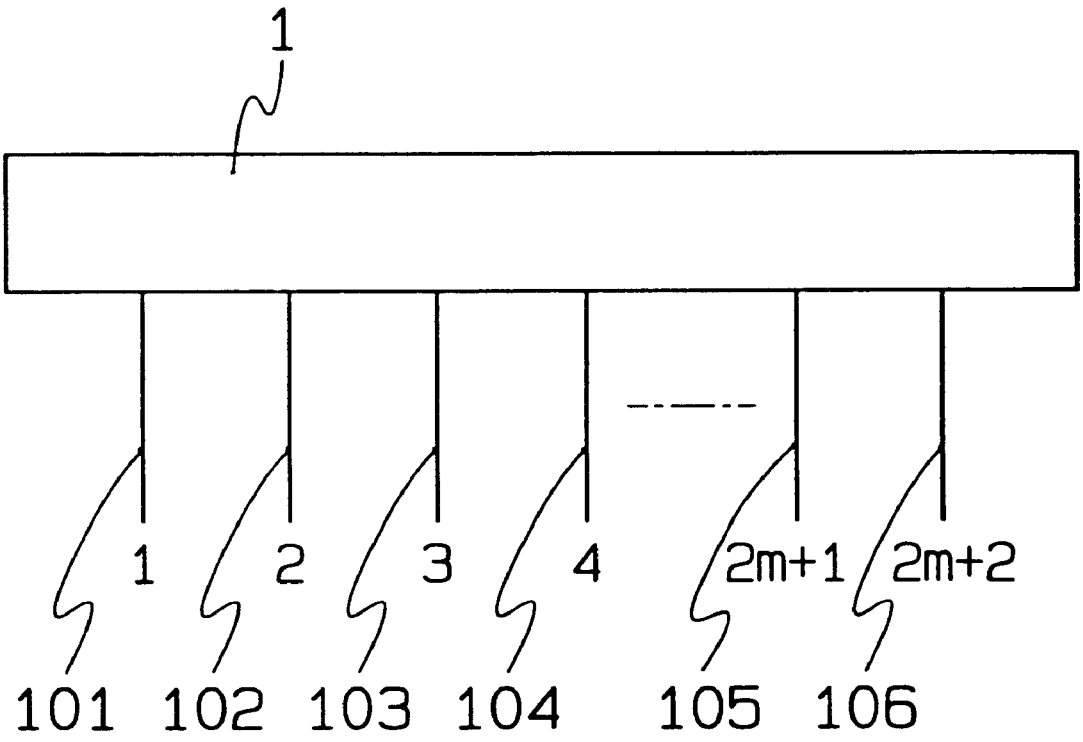
FIG. 12 BACKGROUND ART
FIG. 12 is an illustrative view showing an example of the conventional liquid crystal drive circuit.
Figure 13:
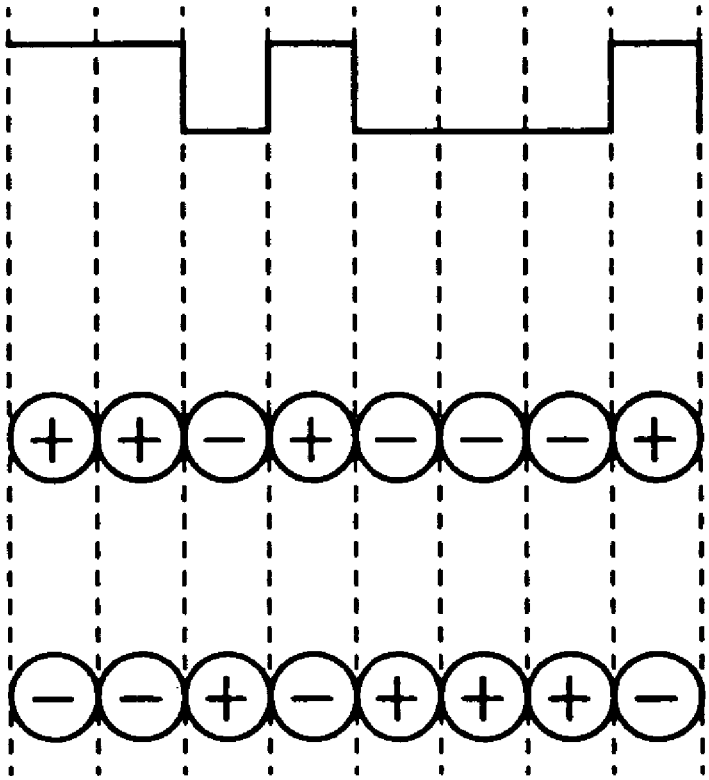
FIG. 13 BACKGROUND ART
FIG. 13 is an illustrative view showing an example of the polarity inversion signal and the polarities of the odd number output and even number output outputted from the liquid crystal drive circuit shown in FIG. 12.
Figure 17A:
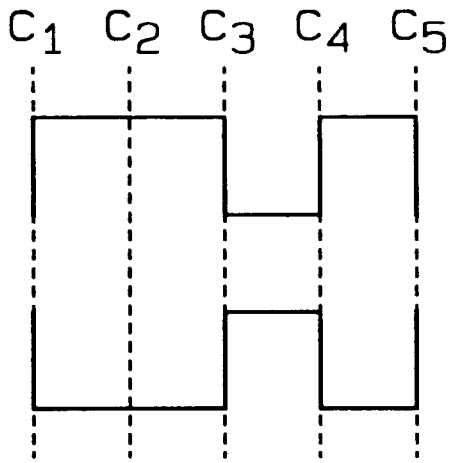
FIG. 17(a) BACKGROUND ART
FIGS. 17(*a*) and 17(*b*) are timing charts showing a signal to be used for driving the LCD device shown in FIGS. 15(*a*) and 15(*b*).
Figure 17B:
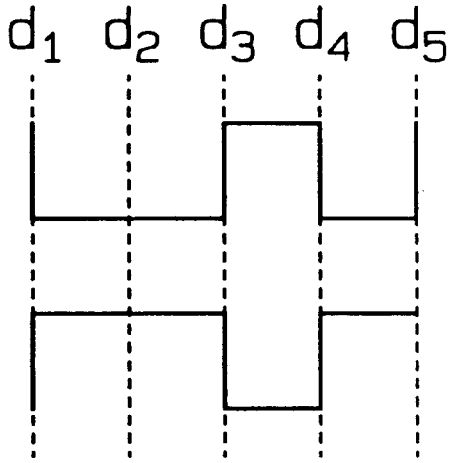
FIG. 17(b) BACKGROUND ART

FIGS. 10(*a*) to 10(*c*) and FIGS. 11(*a*) and 11(*b*) are the timing charts showing the signals to be used for driving the LCD devices shown in FIGS. 6(*a*) and 6(*b*) and FIGS. 7(*a*) and 7(*b*). In FIGS. 10(*a*) to 10(*c*) and FIGS. 11(*a*) and 11(*b*), the same parts as those of FIGS. 16(*a*) to 16(*c*) and FIGS. 17(*a*) and 17(*b*) are shown by using the same numerals.

In FIG. 10(*a*), there are shown fron above the switching timing signal for the first polarity inversion signal and the switching timing signal for the second polarity inversion signal. In FIG. 10(*b*), there are shown from above the first polarity inversion signal and the second polarity inversion signal in n frame. In FIG. 10(*c*), there are shown from above the first polarity inversion signal and the second polarity inversion signal in (n+1) frame. Further, in FIG. 11(*a*), thre are shown from the above the first polarity inversion signal and the second polarity inversion signal in (n+2) frame. In FIG. 11(*b*), there are shown from above the first polarity inversion signal and the second polarity inversion signal in (n+3) frame.

In case of n frame, the polarity of the first polarity inversion signal inputted to the upper liquid crystal drive circuit is in inverse polarity to the polarity of the second polarity inversion signal inputted to the lower liquid crystal drive circuit (referring to FIG. 10(*b*)). Accordingly, those in which the polarities of the image signals applied to the pixel (upper image signal or lower image signal) become the same between the adjacent pixels in a direction parallel to the scanning signal line 12 are the first row pixel with the second row pixel, and third row pixel with the fourth row pixel (referring to FIG. 6(*a*)). That is, the pixels on the (2p+1)-th row and the pixels on the (2p+2)-th row become the same polarity.

Further, in case of (n+1) frame, the polarity of the first polarity inversion signal inputted to the upper liquid crystal drive circuit is the same as in the case of n frame, and the polarity of the second polarity inversion signal inputted to the lower liquid crystal drive circuit is inverse polarity to the case of n frame (referring to FIG. 10(*c*)). Accordingly, those in which the polarities of the image signals applied to the pixel (upper image signal or lower image signal) become the same between the adjacent pixels in a direction parallel to the scanning signal line 12 are the second row pixel with the third row pixel, and fourth row pixel with the fifth row pixel (referring to FIG. 6(*b*)). Namely, the pixels on the (2p+2)-th row and the pixels on the (2p+3)-th row become the same polarity, being different from the case of n frame.

In case of (n+2) frame, in the same manner as in the case of n frame, the image signals of the same polarity are applied to the pixels on the (2p+1)-th row and the pixels on the (2p+2)-th row (referring to FIG. 7(*a*)). However, with respect to the pixel in which the polarity of the image signal applied in n frame is positive (or negative), the polarity of the image signal to be applied in (n+2) frame becomes negative (or positive).

In case of (n+3) frame, the image signals of the same polarity are applied to the pixels on the (2p+2)-th row and the pixels on the (2p+3)-th row (referring FIG. 7(*b*)). However, with respect to the pixel in which the polarity of the image signal applied in (n+1) frame is positive (or negative), the polarity of the image signal to be applied in (n+3) frame becomes negative (or positive).

Accordingly, when classification is made by the pixel to which the image signals of the same polarity are applied and the odd number frame is compared with the even number frame, the pixels constituting the group vary by frame. Furthermore, the comparison between the odd number frames (or even number frames) shows that the polarities of the image signals to be applied to one group are varied. As a result, it becomes possible to average in time and in space the electric fields in the horizontal direction, by which the display defect attributed to the horizontal electric field is not visibly noticed, and the display quality can be improved.

The driving method for the LCD device according to claim 1 of the present invention is a driving method for the LCD device which comprises applying one of the upper image signal outputted from the upper liquid crystal drive circuit and the lower image signal outputted from the lower liquid crystal drive circuit to a plurality of pixels constituting the selected line by the scanning signal outputted from the scanning signal circuit out of the plural pixels disposed in matrix to display a predetermined image, wherein there exist in mixture the case where the polarities of the upper image signal and the lower image signal are inverted every one vertical period and the case where the same polarity is maintained. Accordingly, it is possible to obtain averaging in time and space of the electric fields in horizontal direction, by which the display defect attributed to the horizontal electric field is not visibly noticed, and the display quality can be improved.

The driving method for the LCD device according to claim 2 of the present invention is characterized by applying the upper image signal to every other pixels out of the plural pixels constituting the selected line and applying the lower image signal to the rest of pixels. Accordingly, it is possible to suppress the frequency of the image signal to a level no more than the maximum operating frequency.

Furthermore, the driving method for the LCD device according to claim 3 of the present invention is characterized in that every other pixels as above are the pixels of the odd number, and the rest of pixels are the pixels of the even number. Accordingly, it is possible to maintain the frequency of the image signal to a level no more than the maximum operating frequency.

The driving method for the LCD device according to claim 4 of the present invention is a driving method for the LCD device which comprises applying one of the upper image signal outputted from the upper liquid crystal drive circuit and the lower image signal outputted from the lower liquid crystal drive circuit to a plurality of pixels constituting the selected line by the scanning signal outputted from the scanning signal circuit out of the plural pixels disposed in matrix to display a predetermined image, wherein, in selecting the first line in each frame, the polarities of the upper image signal and the lower image signal are changed every two frames, and the timing for changing the polarity of the upper image signal is displaced at the rate of one frame to the timing for changing the polarity of the lower image signal. Accordingly, it is possible to obtain averaging in time and space of the electric fields in horizontal direction, by which the display defect attributed to the horizontal electric field is not visibly noticed, and the display quality can be improved.

The driving method for the LCD device according to claim 5 of the present invention is characterized by applying the upper image signal to every other pixels out of the plural pixels constituting the selected line and applying the lower image signal to the rest of pixels. Accordingly, it is possible to maintain the frequency of the image signal to a level no more than the maximum operating frequency.

Furthermore, the driving method for the LCD device according to claim 6 of the present invention is characterized in that every other pixels as above are the pixels of the odd number, and the rest of pixels are the pixels of the even number order. Accordingly, it is possible to maintain the frequency of the image signal to a level no more than the maximum operating frequency.

A driving circuit for the LCD device according to claim 7 of the present invention comprises at least an upper liquid crystal drive circuit, a lower liquid crystal drive circuit, a scanning signal circuit, a timing control circuit and a vertical synchronization signal converting circuit, the vertical synchronization signal converting circuit being a drive circuit of LCD for outputting a switching timing signal for a first polarity inversion signal and a switching timing signal for a second polarity inversion signal, wherein the switching timing signal for a first polarity inversion signal and the switching timing signal for a second polarity inversion signal are outputted by the vertical synchronization signal converting circuit such that in n frame polarity of a first polarity inversion signal inputted to the upper liquid crystal drive circuit is made inverted to polarity of a second polarity inversion signal inputted to the lower liquid crystal drive circuit; and in n+1 frame the polarity of a first polarity inversion signal inputted to the upper liquid crystal drive circuit is in the same polarity to the polarity of a second polarity inversion signal inputted to the lower liquid crystal drive circuit. Accordingly, it is possible to obtain averaging in time and space of the electric fields in horizontal direction, by which the display defect attributed to the horizontal electric field is not visibly noticed, and the display quality can be improved.

The driving circuit for the LCD device according to claim 8 of the present invention, is characterized in that the vertical synchronization signal converting circuit comprises a differential circuit, a plurality of flip-flops and a plurality of NOT gates. Accordingly, the desired timing signal for polarity inversion signal can be obtained.

It should be understood that the apparatus and methods which have been shown and described herein are illustrative of the invention and are not intended to be limitative thereof. Clearly, those skilled in the art may conceive of variations or modifications to the invention. However, any such variations or modifications which falls within the purview of this description are intended to be included therein as well. The scope of the invention is limited only by the claims appended hereto.

What is claimed is:

1. A method of driving an LCD device comprising a step of:

applying one of an upper image signal outputted from an upper liquid crystal drive circuit and a lower image signal outputted from a lower liquid crystal drive circuit to a plurality of pixels of a selected line by a scanning signal outputted from a scanning signal circuit out of a plurality of pixels disposed in a matrix to display a predetermined image;

wherein, in the applying step, a mixture of two cases exists:

a first case in which a polarity of said upper image signal and a polarity of said lower image signal are inverted with respect to each other in the unit of one vertical period; and a second case in which the polarity of said upper image signal and the polarity of said lower image signal are not inverted with respect to each other.

2. The method of claim 1, wherein said upper image signal is applied to every other pixel out of said plurality of pixels constituting a selected line and said lower image signal is applied to each remaining pixel.

3. The method of claim 2, wherein every other pixel is a pixel of odd number, and the remaining pixels are pixels of even number.

4. A method of driving an LCD device comprising a step of:

applying one of an upper image signal outputted from an upper liquid crystal drive circuit and a lower image signal outputted from a lower liquid crystal drive circuit to a plurality of pixels of a selected line by a scanning signal outputted from a scanning signal circuit out of a plurality of pixels disposed in a matrix to display a predetermined image;

wherein, in selecting a first line in each frame, polarities of said upper image signal and said lower image signal are changed every two frames, and timing for changing polarity of said upper image signal is displaced at a rate of one frame to timing for changing polarity of said lower image signal.

5. The method of claim 4, wherein said upper image signal is applied to every other pixel out of said plurality of pixels of a selected line and said lower image signal is applied to the remaining pixels.

6. The method of claim 5, wherein every other pixel is a pixel of odd number, and the remaining pixels are pixels of even number.

7. A driving circuit for an LCD device comprising at least an upper liquid crystal drive circuit, a lower liquid crystal drive circuit, a scanning signal circuit, a timing control circuit and a vertical synchronization signal converting circuit, said vertical synchronization signal converting circuit outputting a switching timing signal for a first polarity inversion signal and a switching timing signal for a second polarity inversion signal, wherein said switching timing signal for a first polarity inversion signal and said switching timing signal for a second polarity inversion signal are outputted by said vertical synchronization signal converting circuit such that in n frame polarity of a first polarity inversion signal inputted to said upper liquid crystal drive circuit is made inverted to polarity of a second polarity inversion signal inputted to said lower liquid crystal drive circuit; and in n+1 frame said polarity of a first polarity inversion signal inputted to said upper liquid crystal drive circuit is in the same polarity as said polarity of a second polarity inversion signal inputted to said lower liquid crystal drive circuit.

8. The driving circuit for the LCD device of claim 7, wherein said vertical synchronization signal converting circuit comprises a differential circuit, a plurality of flip-flops and a plurality of NOT gates.

* * * * *